United States Patent [19]

Hull

[11] 4,450,597

[45] May 29, 1984

[54] CONVERTIBLE BED

[76] Inventor: James R. Hull, 148 S. Westgate Ave., Los Angeles, Calif. 90049

[21] Appl. No.: 381,186

[22] Filed: May 24, 1982

[51] Int. Cl.[3] ..... A47B 83/00

[52] U.S. Cl. ..... 5/2 R; 5/93 B; 5/8; 5/9 R; 5/285

[58] Field of Search ..... 5/2 R, 8, 9 R, 93 R, 5/93 B, 99 B, 181, 183, 185, 285, 286, 425; 292/173; D6/79–84

[56] References Cited

U.S. PATENT DOCUMENTS

| | | | |
|---|---|---|---|
| 2,223,955 | 12/1940 | Greenbaum | 5/2 R |
| 2,558,625 | 6/1951 | Pearce | 5/183 |

FOREIGN PATENT DOCUMENTS

| | | | |
|---|---|---|---|
| 485356 | 7/1952 | Canada | 5/4 |
| 706565 | 3/1965 | Canada | 5/118 |

*Primary Examiner*—Alexander Grosz
*Assistant Examiner*—Michael F. Trettel
*Attorney, Agent, or Firm*—Keith D. Beecher

[57] ABSTRACT

A convertible bed is provided which may take the form of a crib that can be converted into a youth bed when the child outgrows the crib. The assembly comprises essentially a plurality of elongated rectangular side and end rails and a number of rectangular rigid panels. In each unit, the rigid panels are positioned in diagonally displaced relationship at the corners of the bed at each side and at each end, and the rails extend between the panels. The panels are provided with a series of holes along each side edge, and the ends of the rails are provided with holes, so that the rails may be easily attached to the panels with appropriate screws. The side rails extend across the inner face of the corresponding side panels in the case of the crib, so that the crib may have a foreshortened length. On the other hand, the side rails extend only to the inner edges of the side panels in the case of the youth bed, and the side panels contribute to the length of the bed, so that the overall length of the bed may be longer than the length of the crib.

6 Claims, 4 Drawing Figures

CONVERTIBLE BED

BACKGROUND OF THE INVENTION

The convertible bed of the present invention is of the same general type as disclosed in copending application Ser. No. 205,103 now U.S. Pat No. 4,361,919, which was filed Nov. 10, 1980 in the name of the present inventor. The principal objective of the present invention is to provide a modular bed assembly which can originally be assembled as a crib, and then, when the child outgrows the crib, can easily be converted into a youth bed, without the need for any additional pieces.

The assembly of the invention, as mentioned above, consists basically of rectangular rigid panels with holes along each side, and rectangular side and end rails with holes at each end, so that the assembly may be readily assembled and disassembled, and just as readily converted from a crib into a youth bed. Moreover, the assembly of the invention is simple and inexpensive to make, and is capable of being shipped in a relatively small package.

The construction is such that the youth beds can be stacked on top of one another to form usual bunks; or across one another to form space-saving corner bunks, with room for a chest of drawers, and other accessories underneath one end of the upper bunk.

The cribs and beds constructed from the assembly of the invention are attractive in appearance, and when assembled, are rigid, strong and sturdy.

DETAILED DESCRIPTION OF THE ILLUSTRATED EMBODIMENT

Figure 1:
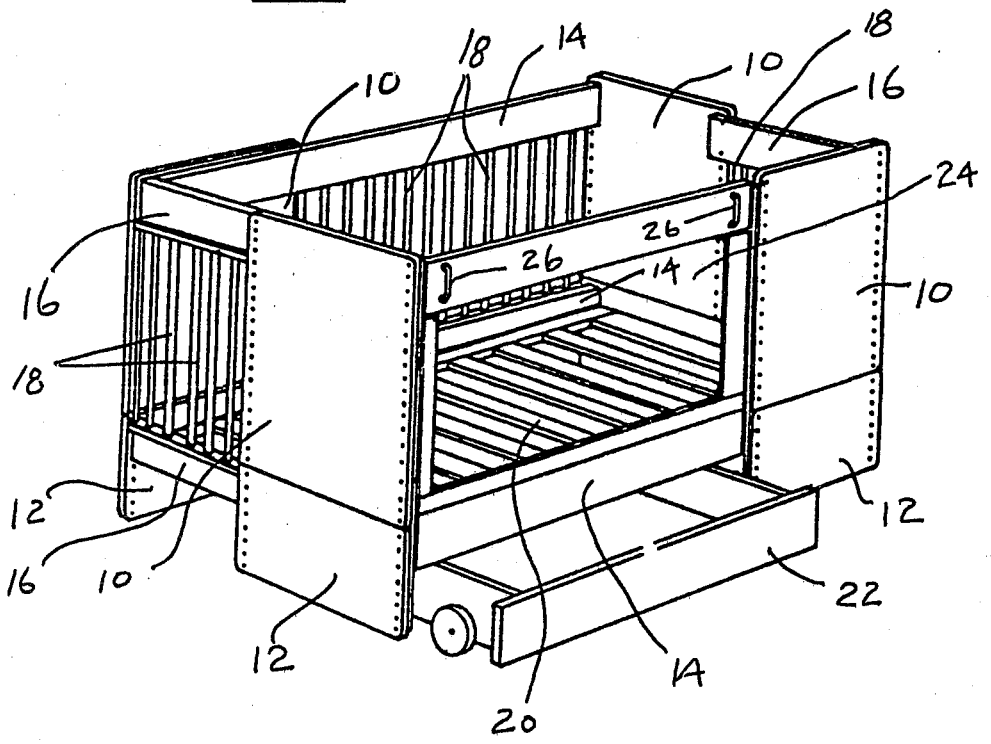
FIG. 1 is a perspective representation of a crib constructed in accordance with the concepts of the present invention, and having a vertically slidable side panel which is shown in its upper position to enclose the interior of the crib and which may be lowered to a lower position to permit access to the interior of the crib.

The crib of FIG. 1 is formed of four identical panels 10, and four identical panels 12 which are supported at each corner of the crib, with the panels 10 being positioned directly over the panels 12. As shown in FIG. 1, two of the panels 10 are supported at the ends of the crib at diagonally opposite corners, and two of the panels are supported at the sides of the crib, likewise, at diagonally opposite corners. The panels 12 are similarly positioned.

The crib is held in its assembled condition by side rails, such as the side rails 14, and by end rails such as the end rails 16. The panels 10 and 12, as shown, are provided with a series of holes at each edge; and the rails 14 and 16 are likewise provided with holes at each end. The rails are secured to the panels 10 and 12 by appropriate screws. A plurality of upright posts 18 are provided between the end rails, and also between the side rails, as shown.

In the case of the crib, and as shown in FIG. 1, the side rails 14 extend across the inner faces of the corresponding side panels 10, so that the crib may have a fore-shortened length, corresponding to the actual length of the side rails. The crib is also equipped with a mattress support structure 20 which, in the illustrated embodiment, can be formed of a plurality of spaced transverse slats supported at each end by the corresponding side rails.

Figure 1A:
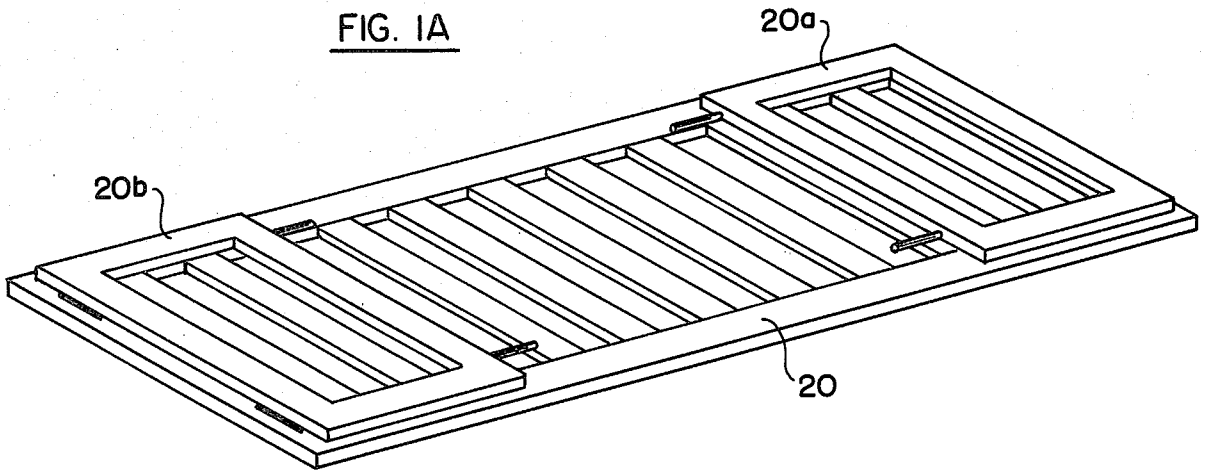
FIG. 1A is a bottom perspective view of a mattress support for the crib having end members in a turned-in position so that the mattress may be supported in the crib at a lower position, it being understood that the mattress support is actually turned upside down when placed in the crib.
Figure 1B:
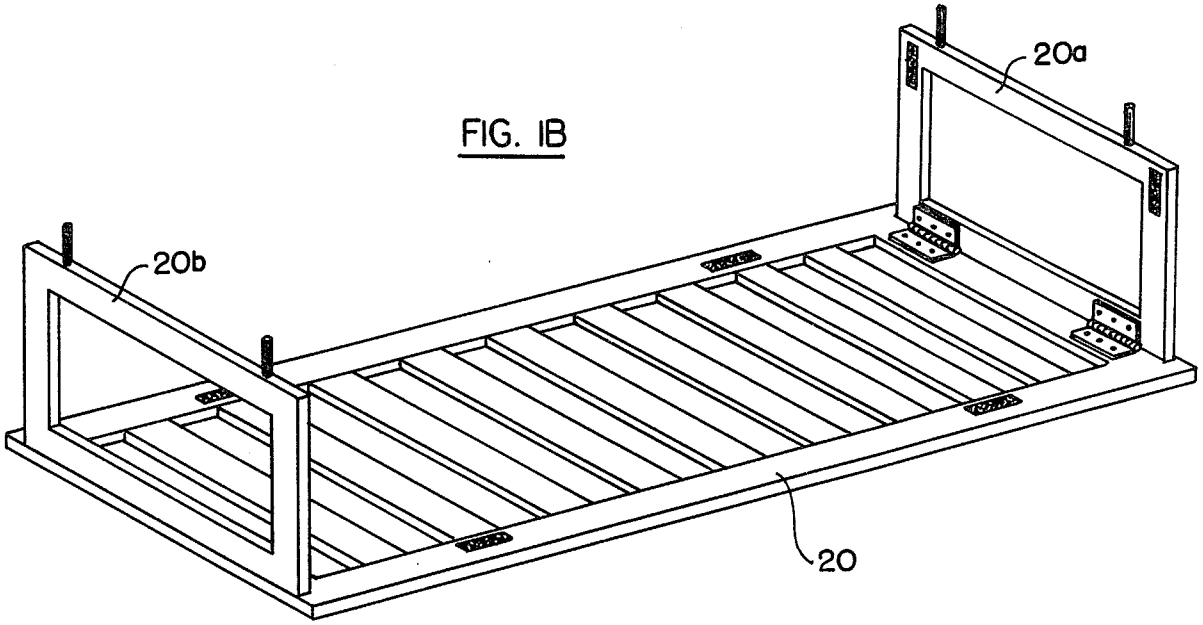
FIG. 1B is a bottom perspective view of the mattress support with its end members turned out so that the mattress may be supported in the crib in an upper position, suitable for small infants, again it being understood that the support is turned upside down when placed in the crib.

The mattress support structure, as shown in FIGS. 1A and 1B has hinged end members which may be turned down (FIG. 1A) to enable the mattress to be supported in a lower position in the crib; and which may be turned up (FIG. 1B) to enable the mattress to be supported in an upper position in the crib, suitable for small rails.

The crib may also be equipped with a drawer 22 which may be rolled in and out under the mattress support structure 20, the latter being displaced up from the lower edges of the panels 12.

The crib is also equipped with a vertically slidable transparent panel 24. Panel 24 is movable on vertical bars between an upper position shown in FIG. 1, in which it encloses the interior of the crib; and a lower position in which it permits access to the interior of the crib. Drawer 22, of course, must be closed before the panel 24 can be moved to its lower position.

Figure 1C:
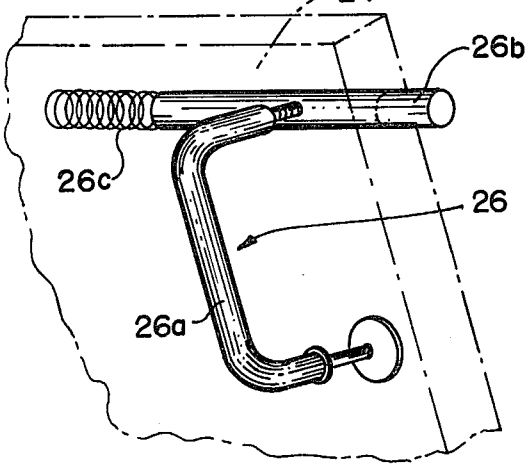
FIG. 1C is a perspective representation of one of two latches which are used to hold the vertical slidable side panel of FIG. 1 in its upper position.

Panel 24 is held in its upper position by a pair of latches 26. As shown in FIG. 1C, each of the latches 26 is equipped with a U-shaped handle **26*a* which is pivotally mounted on panel 24 at its lower end, and which is coupled to a latch rod 26*b* at its upper end. Latch rod 26*b* is spring-biased by a spring 26*c* to the position illustrated in FIG. 1C, in which it protrudes through the edge of the sliding panel 24**, and into an appropraite receptacle adjacent to the edge of the sliding panel.

The handle **26*a* is turned in a counterclockwise direction to move the latch rod 26*b* inwardly against the bias of spring 26*c* so as to release the panel 24, and permit the panel to drop to its lower position. As mentioned above, drawer 22 must be closed before panel 24** can be dropped to its lower position.

In the views of FIGS. 1 and 1A, the mattress support structure 20 is in a lowermost position. However, as shown in FIG. 1B, the mattress support 20 can be raised to an upper position, so that, when the infant is very small, he or she may be supported closer to the top of the crib for ready access.

Figure 2:
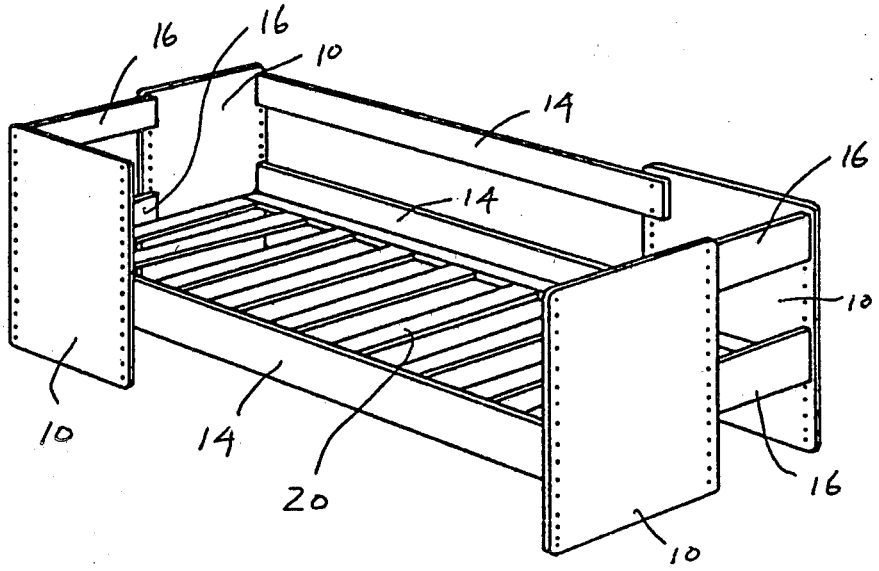
FIG. 2 is a perspective representation of a youth bed which is constructed from the components of the crib of FIG. 1, without the need for any additional components.

As shown in FIG. 2, when the child has outgrown the crib of FIG. 1, the same components can be assembled to provide a youth bed. In the embodiment of FIG. 2, the side rails 14 extended only to the inner edges of the side panels 10, so that the side panels contribute to the overall length of the bed, so that it may be longer than the crib of FIG. 1. An extension piece may be provided for supporting the mattress, so as to take care of the increased length of the bed.

Figure 3:
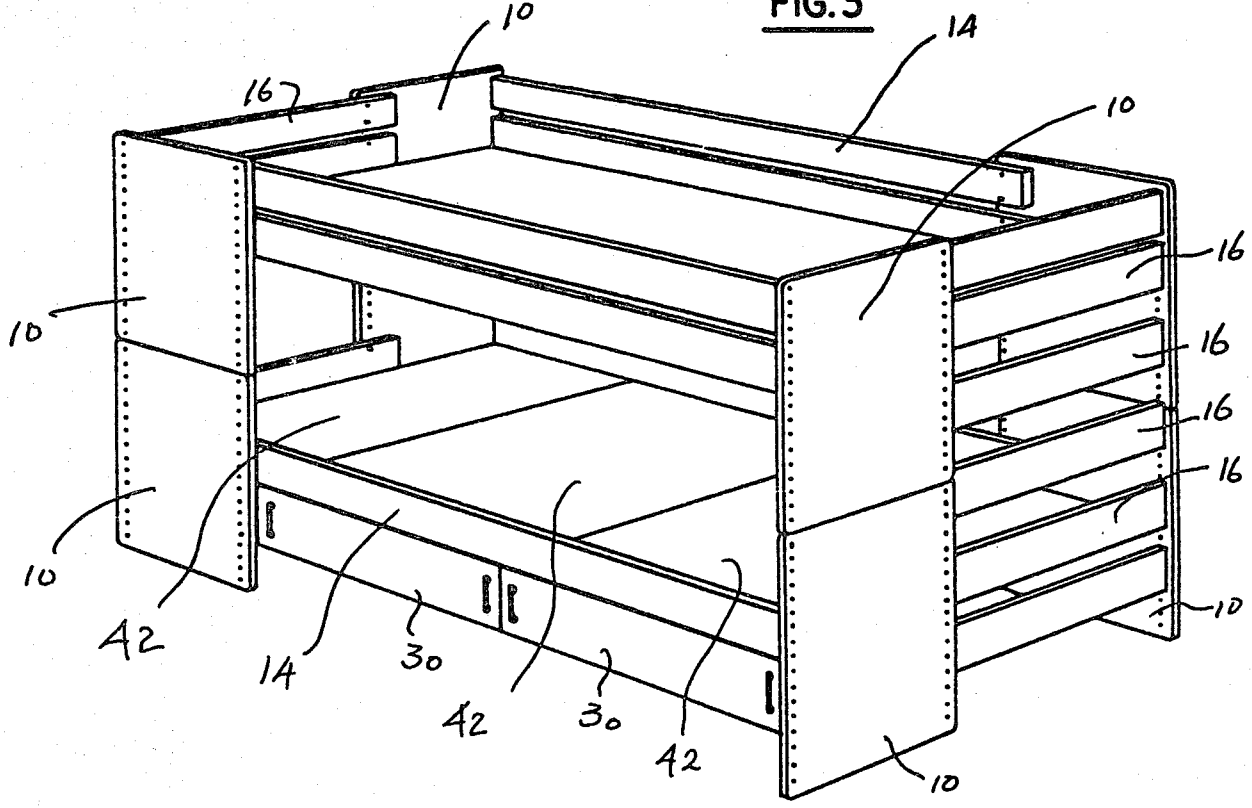
FIG. 3 is a perspective representation of two twin beds, similar to but somewhat larger than the beds of FIG. 2, stacked on one another to form bunks.

As shown in FIG. 3, two like beds somewhat larger than the bed shown in FIG. 2, may be stacked on top of one another to form bunks. For example, the bed shown in FIG. 2 may have a size to receive a mattress measuring approximately 28"×66". The beds shown in FIG. 3 may have the same sized panels 10, but may have a size to receive mattresses measuring approximately 39"×75". For this purpose the beds of FIG. 3 have longer side and end rails and larger mattress supports than the bed of FIG. 2. In the latter embodiment, additional end rails may be used at one end to provide a ladder. Also, drawers, such as drawers 30 may be incorporated under the lower bunk. The upper and lower panels 10 may be secured to one another by appropriate studs extending from the upper edges of the lower panels, for example, into corresponding holes formed in the lower edges of the upper panels.

Figure 4:
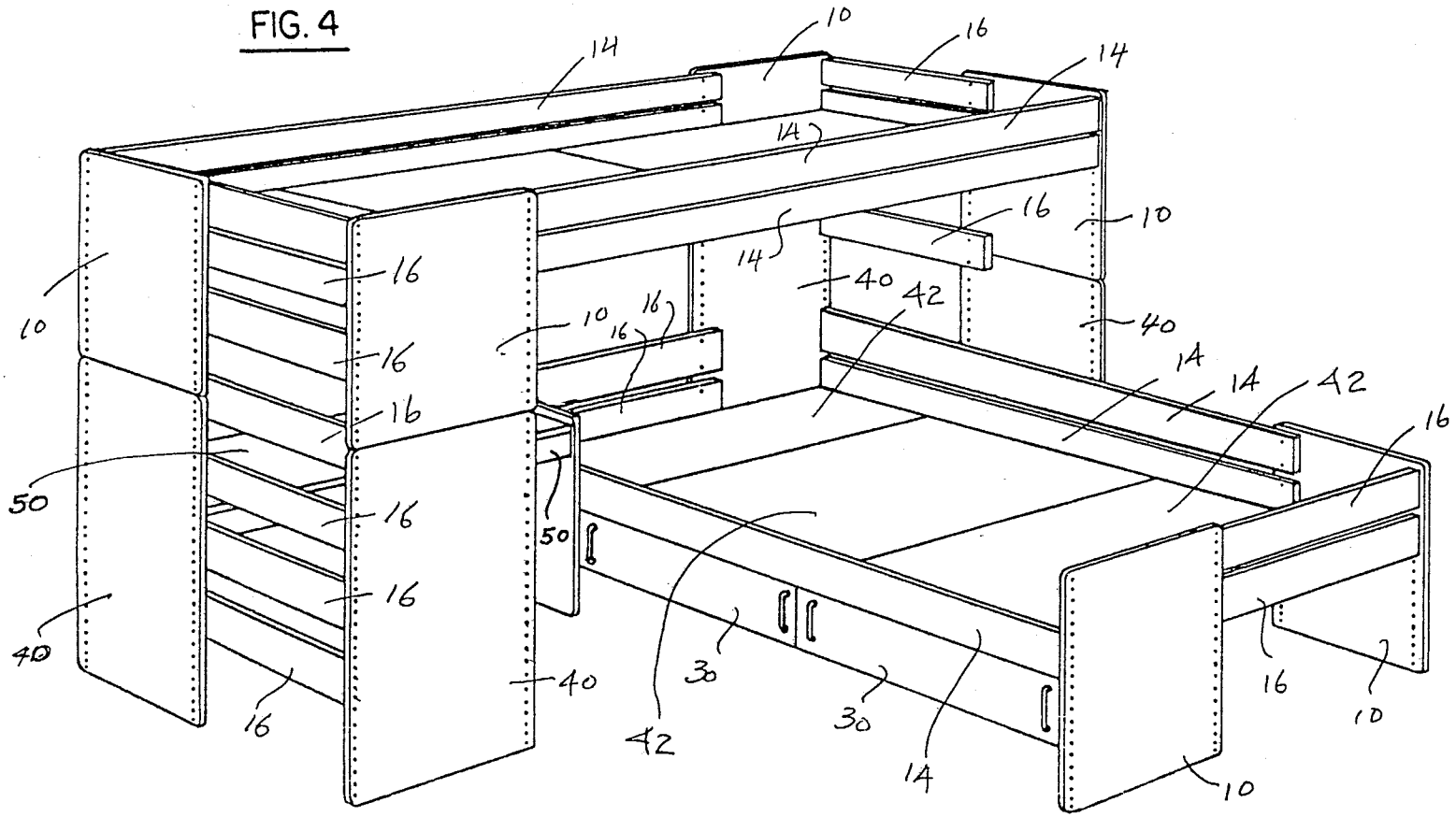
FIG. 4 is a perspective view of two twin beds, and other accessories, stacked with the upper bunk extending across one end of the lower bunk, appropriate for positioning in a corner of a room and providing space for accessories.

In the embodiment of FIG. 4, the upper bunk is mounted on additional panels 40 which are higher than panels 10, but of the same width, and extends across one end of the lower bunk at right-angles thereto. The beds themselves may be similar in size to the beds of FIG. 3. The fact that panels 10 and 14 are mounted at diagonally opposite corners of the bed is most important since it permits the overall structure to be placed closely adjacent to the right side wall of the room and still leave maximum space for an accessory, such as desk 50 under the left-hand end of the upper bunk.

Also, as in the embodiment of FIG. 3, additional end rails 16 may be provided at one end of the upper bunk, to form a ladder. The slats 20 of the embodiments of FIGS. 1 and 2 may be replaced, if so desired, by plywood slabs 42 in the embodiments of FIGS. 3 and 4.

It will be appreciated, of course, that while particular embodiments of the convertible bed of the invention have been shown and described, modifications may be made, and it is intended in the appended claims to cover all such modifications which come within the true spirit and scope of the invention.

What is claimed is:

1. A rectangular convertible bed comprising: at least four rigid rectangular panels; a plurality of elongated rectangular side and end rails secured to the panels and extending therebetween to support the panels in an upright position at each corner of the bed, with two of the panels constituting side panels at first and second diagonally opposite corners of the bed, and with two of the panels constituting end panels for the bed at third and fourth diagonally opposite corners of the bed, said bed having a first configuration in which the side rails extend across the inner faces of the respective side panels to provide a crib of fore-shortened length, and said bed having a second configuration in which the side rails extend only to the inner side edges of the respective side panels, so that the width of the side panels contribute to the length of the bed; and mattress support means supported by said rails adjacent to the lower edges of said panels.

2. The convertible bed defined in claim 1, and which includes adjustable means for enabling said mattress support means to be set selectively to a predetermined lower position and to a predermined upper position.

3. The convertible bed defined in claim 1, and which includes a like bed mounted on top of the aforesaid bed with the lower edges of the panels of the like bed engaging the upper edges of the corresponding panels of the aforesaid bed.

4. The convertible bed defined in claim 1, and which includes a like bed supported across the end of the aforesaid bed at right angles thereto.

5. A rectangular convertible bed comprising: at least four rigid rectangular panels; a plurality of elongated, rectangular side and end rails secured to the panels and extending therebetween to support the panels in an upright position at each corner of the bed, with two of the panels constituting side panels for the bed at first and second diagonally opposite corners, and with two of the panels constituting end panels for the bed at third and fourth diagonally opposite corners of the bed, in which the side rails extend across the inner faces of the respective side panels to provide a crib configuration of fore-shortened length; and mattress support means supported by said rails and displaced up from the lower edges of said panels; and which includes a slidable panel supported along one side of the bed in its crib configuration between the outer edge of an end panel and the inner edge of a side panel, said slidable panel being slidable vertically between an upper position to include the interior of the bed in its crib configuration and a lower position to permit access to the interior of the bed in its crib configuration.

6. The convertible bed defined in claim 5 and which includes a pair of latches for releasably holding the slidable panel in its upper position, each of said latches including a spring-biased plunger normally protruding beyond the corresponding end of the slidable panel, and a pivotally mounted U-shaped handle attached to said plunger for causing said plunger to retract against its spring-bias when the handle is manually turned about its pivot axis.

* * * * *